US010150639B2

(12) United States Patent
Dahlmann et al.

(10) Patent No.: US 10,150,639 B2
(45) **Date of Patent: *Dec. 11, 2018**

(54) WRAP DISPENSER WITH FLAT RIM CAP

(71) Applicant: Pratt Corrugated Holdings, Inc., Conyers, GA (US)

(72) Inventors: Deborah A. Dahlmann, Marietta, GA (US); Christopher M. Stanton, Peachtree City, GA (US); John Richard Muse, Douglasville, GA (US); Dawn F. Jones, McDonough, GA (US)

(73) Assignee: Pratt Corrugated Holdings, Inc., Conyers, GA (US)

( * ) Notice: Subject to any disclaimer, the term of this patent is extended or adjusted under 35 U.S.C. 154(b) by 186 days.

This patent is subject to a terminal disclaimer.

(21) Appl. No.: 15/215,025

(22) Filed: Jul. 20, 2016

(65) Prior Publication Data

US 2018/0022565 A1 Jan. 25, 2018

(51) Int. Cl.
*B65H 75/18* (2006.01)
*B65B 67/08* (2006.01)
(Continued)

(52) U.S. Cl.
CPC ..... *B65H 37/005* (2013.01); *B65H 16/005* (2013.01); *B65H 2801/81* (2013.01)

(58) Field of Classification Search
CPC ..... B65B 67/085; B65H 16/04; B65H 2402/412; B65H 75/18; B65H 75/185; B65H 75/406
See application file for complete search history.

(56) References Cited

U.S. PATENT DOCUMENTS 1,364,259 A 1/1921 Eaton
1,451,914 A 4/1923 Kongsrud
(Continued)

FOREIGN PATENT DOCUMENTS

DE 1924348 11/1970
DE 202004011730 11/2004
(Continued)

OTHER PUBLICATIONS

Stanton, Christopher M.; Issue Notification for U.S. Appl. No. 15/001,281, filed Jan. 20, 2016, dated Jun. 7, 2017, 1 page.
(Continued)

*Primary Examiner* — William A. Rivera
(74) *Attorney, Agent, or Firm* — Taylor English Duma LLP

(57) ABSTRACT

A dispenser includes a rotating member including a first end and a second end, the rotating member having an inner surface and defining an axis of rotation that extends from the first end to the second end, a holding member having an inner surface, an outer holding surface, and a collar at a first end of the holding member, the inner surface enclosing an engaging portion of the rotating member, the holding member configured to rotate relative to the rotating member, and a cap attached to the first end of the rotating member and retaining the holding member on the rotating member, the collar of the holding member positioned at least partially directly between an end surface at the first end of the rotating member and a stop surface of the cap, an end gap between the end surface and the stop surface providing clearance for the collar.

22 Claims, 10 Drawing Sheets

(51) Int. Cl.
*B65H 37/00* (2006.01)
*B65H 16/00* (2006.01)

(56) References Cited

U.S. PATENT DOCUMENTS

| | | | |
|---|---|---|---|
| 1,935,392 | A | 11/1933 | Coninck |
| 2,331,743 | A | 10/1943 | Sullivan |
| 3,856,229 | A | 12/1974 | Bryam |
| 4,102,513 | A | 7/1978 | Guard |
| 4,166,589 | A | 9/1979 | Hooever |
| 4,179,081 | A | 12/1979 | Parry |
| 4,226,380 | A | 10/1980 | Gay |
| 4,248,392 | A | 2/1981 | Parry |
| 4,339,022 | A | 7/1982 | Hoover |
| 4,372,500 | A | 2/1983 | Saraisky |
| D268,514 | S | 4/1983 | Thompson |
| 4,477,037 | A | 10/1984 | Goldstein |
| 4,484,717 | A | 11/1984 | Goldstein |
| 4,530,473 | A | 7/1985 | Parry |
| 4,575,020 | A | 3/1986 | Strout et al. |
| 4,600,163 | A | 7/1986 | Hummel et al. |
| 4,659,031 | A | 4/1987 | Saraisky |
| 4,706,442 | A | 11/1987 | Riemenschneider |
| 4,722,493 | A | 2/1988 | Parry et al. |
| 4,752,045 | A | 6/1988 | Goldstein |
| 4,784,348 | A | 11/1988 | McDonald |
| 4,817,762 | A | 4/1989 | Powell |
| 4,834,312 | A | 5/1989 | Riemenschneider, III |
| 4,872,623 | A | 10/1989 | Parry et al. |
| 4,874,139 | A | 10/1989 | Kewin |
| 4,971,265 | A | 11/1990 | Koch |
| 5,094,395 | A | 3/1992 | Lambert |
| 5,135,179 | A | 8/1992 | Morano |
| 5,150,852 | A | 9/1992 | Hunt et al. |
| 5,186,376 | A | 2/1993 | Scharf et al. |
| 5,190,237 | A | 3/1993 | Fagan |
| 5,203,517 | A | 4/1993 | Parry et al. |
| 5,310,074 | A | 5/1994 | Jochem et al. |
| 5,351,905 | A | 10/1994 | Ferber |
| 5,398,884 | A | 3/1995 | Stanford |
| 5,409,177 | A | 4/1995 | Parry et al. |
| 5,490,642 | A | 2/1996 | Schwartz |
| D371,298 | S | 7/1996 | Reddy |
| 5,573,630 | A | 11/1996 | Edney et al. |
| 5,664,739 | A | 9/1997 | Black et al. |
| 5,868,334 | A | 2/1999 | Cedillo |
| 5,915,642 | A | 6/1999 | Davis |
| 5,927,635 | A | 7/1999 | Black et al. |
| 5,938,142 | A | 8/1999 | Halperin |
| 5,961,063 | A | 10/1999 | Parry |
| 6,015,111 | A | 1/2000 | Berke |
| 6,019,308 | A | 2/2000 | Huang |
| 6,027,069 | A | 2/2000 | Huang |
| D424,341 | S | 5/2000 | Anderberg |
| D425,347 | S | 5/2000 | Anderberg |
| 6,102,323 | A | 8/2000 | Riemenschneider |
| 6,227,479 | B1 | 5/2001 | Dean et al. |
| 6,227,480 | B1 | 5/2001 | Huang |
| 6,398,150 | B1 | 6/2002 | Munter et al. |
| 6,422,499 | B1 | 7/2002 | Bernard et al. |
| 6,491,252 | B2 | 12/2002 | Komatsu et al. |
| 6,508,430 | B1 | 1/2003 | Rodriguez |
| 6,517,023 | B2 | 2/2003 | Rodriguez |
| 6,651,918 | B2 | 11/2003 | Huang |
| 6,676,069 | B1 | 1/2004 | Davis |
| 6,739,542 | B1 | 5/2004 | Prina et al. |
| 6,883,298 | B2 | 4/2005 | Gooding et al. |
| 6,892,975 | B2 | 5/2005 | Chen |
| 6,905,045 | B2 | 6/2005 | Yu |
| 6,926,225 | B1 | 8/2005 | Powers |
| 6,997,411 | B2 | 2/2006 | Kewin |
| 7,017,743 | B1 | 3/2006 | Patterson |
| 7,210,649 | B2 | 5/2007 | Yu Chen |
| 7,380,744 | B1 | 6/2008 | Yu Chen |
| 7,401,449 | B2 | 7/2008 | Watson et al. |
| 7,438,254 | B2 | 10/2008 | Oettershagen |
| D593,464 | S | 6/2009 | Mentis |
| 7,543,426 | B1 | 6/2009 | Phero |
| 7,552,891 | B2 | 6/2009 | Huang |
| 7,665,686 | B2 | 2/2010 | Becker et al. |
| D612,179 | S | 3/2010 | Huang |
| 7,726,600 | B2 | 6/2010 | Huang |
| 7,762,490 | B1 | 7/2010 | Yu Chen |
| 7,866,596 | B2 | 1/2011 | Yamada |
| 7,900,421 | B2 | 3/2011 | Smith |
| 7,937,915 | B2 | 5/2011 | Kohn et al. |
| 8,104,705 | B2 | 1/2012 | Yu Chen |
| 8,308,102 | B2 | 11/2012 | Lin |
| 8,317,124 | B2 | 11/2012 | Yu Chen |
| 8,468,778 | B2 | 6/2013 | Windheuser |
| 8,578,683 | B2 | 11/2013 | Smith |
| 8,616,490 | B2 | 12/2013 | Blok |
| 8,622,332 | B2 | 1/2014 | Bologna |
| 8,708,267 | B2 | 4/2014 | Morgan |
| 8,783,428 | B2 | 7/2014 | Beri |
| 9,010,675 | B2 | 4/2015 | Harrison |
| 9,272,870 | B2 | 3/2016 | Stanton |
| 9,284,085 | B2 | 3/2016 | Pace |
| 9,688,507 | B2 | 6/2017 | Stanton |
| 9,802,722 | B1 | 10/2017 | Bison |
| 9,908,656 | B2 * | 3/2018 | Dahlmann ..... B65B 67/085 |
| 9,926,093 | B2 | 3/2018 | Chen |
| 9,950,896 | B2 | 4/2018 | Stanton |
| 9,988,171 | B2 | 6/2018 | Dahlmann et al. |
| D823,905 | S | 7/2018 | Walters et al. |
| 2001/0032904 | A1 | 10/2001 | Liu |
| 2002/0070310 | A1 | 6/2002 | Liu |
| 2003/0132336 | A1 | 7/2003 | Huang |
| 2003/0141406 | A1 | 7/2003 | Liu |
| 2004/0065577 | A1 | 4/2004 | Yu Chen |
| 2004/0084559 | A1 | 5/2004 | Fraser |
| 2004/0134820 | A1 | 7/2004 | Katayama |
| 2004/0245282 | A1 | 12/2004 | Yu Chen |
| 2005/0168047 | A1 | 8/2005 | Grier |
| 2006/0032965 | A1 | 2/2006 | Yu Chen |
| 2006/0071118 | A1 | 4/2006 | Offerhaus |
| 2006/0175460 | A1 | 8/2006 | Hua |
| 2006/0237577 | A1 | 10/2006 | Chen |
| 2006/0278751 | A1 | 12/2006 | Yu Chen |
| 2007/0045465 | A1 | 3/2007 | Oettershagen |
| 2007/0063092 | A1 | 3/2007 | Zevin et al. |
| 2007/0151208 | A1 | 7/2007 | Huang |
| 2008/0072538 | A1 | 3/2008 | Kohn et al. |
| 2008/0258002 | A1 | 10/2008 | Migliaccio |
| 2009/0044494 | A1 | 2/2009 | Northrup |
| 2009/0127372 | A1 | 5/2009 | Saraisky |
| 2009/0308968 | A1 | 12/2009 | Piotrowski et al. |
| 2010/0044491 | A1 | 2/2010 | Ritchey et al. |
| 2011/0095122 | A1 | 4/2011 | Yu Chen |
| 2011/0233321 | A1 | 9/2011 | Yu Chen |
| 2011/0284680 | A1 | 11/2011 | Lin |
| 2012/0153063 | A1 | 6/2012 | Furuichi |
| 2012/0181369 | A1 | 7/2012 | Blok |
| 2013/0152384 | A1 | 6/2013 | Yu Chen |
| 2014/0110616 | A1 | 4/2014 | Freeth |
| 2014/0116004 | A1 | 5/2014 | Pace |
| 2016/0137454 | A1 | 5/2016 | Stanton |
| 2016/0264277 | A1 | 9/2016 | Dahlmann |
| 2016/0355293 | A1 | 12/2016 | Clarke |
| 2017/0016550 | A1 | 1/2017 | Sliger |
| 2017/0137160 | A1 | 5/2017 | Yu Chen |
| 2017/0260020 | A1 | 9/2017 | Stanton |
| 2018/0194590 | A1 | 7/2018 | Stanton |
| 2018/0257889 | A1 | 9/2018 | Walters et al. |

FOREIGN PATENT DOCUMENTS

| | | |
|---|---|---|
| EP | 0030572 | 6/1981 |
| EP | 0227564 | 7/1987 |
| EP | 0310291 | 4/1989 |
| EP | 0499761 | 8/1992 |
| FR | 2588841 | 5/1988 |
| FR | 2910887 | 12/2009 |
| GB | 2055345 | 3/1981 |

(56) References Cited

FOREIGN PATENT DOCUMENTS

| | | |
|---|---|---|
| GB | 2289039 | 11/1995 |
| GB | 2299321 | 10/1996 |
| GB | 2456801 | 7/2009 |
| GB | 2478933 | 9/2011 |
| JP | H0769349 | 3/1995 |
| TW | 201026567 | 7/2010 |
| WO | 1993010006 | 5/1993 |
| WO | 1995000395 | 1/1995 |
| WO | 2007066194 | 6/2007 |

OTHER PUBLICATIONS

Stanton, Christopher M.; Notice of Allowability for U.S. Appl. No. 15/001,281, filed Jan. 20, 2016, dated Apr. 26, 2017, 6 pgs.
Dahlmann, Deborah A.; Notice of Allowance for U.S. Appl. No. 14/609,567, filed Jan. 30, 2015, dated Jul. 6, 2017, 17 pgs.
"Hand Savers Stretch Wrap Film Hand Dispenser" www.ebay.com; http://www.ebay.com/itm/Hand-Savers-Stretch-Wrap-Film-Hand-Dispenser-1-set-/251286375179 (Accessed Jun. 10, 2013), 3 pgs.
"Stretch film—BK Holder" www.benkaico.com; http://www.benkaico.com/product-area/stretch-film---bk-holder (Accessed Jun. 10, 2013), 2 pgs.
"Stretch Film Dispenser—Hand Core Insert 3" www.aaabalingandstrapping.com; http://www.aaabalingandstrapping.com/index.php?main_page=product_info&cPath=8&products_id=183&zenid=3tkfdrfajbi8ha9ducbdvfclv4 (Accessed Jun. 10, 2013), 2 pgs.
Stanton, Christopher M.; Notice of Allowance for U.S. Appl. No. 15/606,361, filed May 26, 2017, dated Dec. 14, 2017, 30 pgs.
Stanton, Christopher M.; Supplemental Notice of Allowance for U.S. Appl. No. 15/606,361, filed May 26, 2017, dated Jan. 16, 2018, 6 pgs.
Stanton, Christopher M.; Supplemental Notice of Allowance for U.S. Appl. No. 15/606,361, filed May 26, 2017, dated Dec. 28, 2017, 4 pgs.
Dahlmann, Deborah A.; Issue Notification for U.S. Appl. No. 14/609,567, filed Jan. 30, 2015, dated Feb. 14, 2018, 1 pg.
Dahlmann, Deborah A.; Final Office Action for U.S. Appl. No. 14/609,567, filed Jan. 30, 2015, dated Oct. 20, 2016; 11 pgs.
Stanton, Christopher M.; Issue Notification for U.S. Appl. No. 14/108,881, filed Dec. 17, 2013, dated Feb. 10, 2016, 1 pg.
Stanton, Christopher M.; Non-Final Office Action for U.S. Appl. No. 14/108,881, filed Dec. 17, 2013, dated Sep. 23, 2015, 29 pgs.
Stanton, Christopher M.; Notice of Allowance for U.S. Appl. No. 14/108,881, filed Dec. 17, 2013, dated Nov. 24, 2015, 5 pgs.
Stanton, Christopher M.; U.S. Patent Application entitled: Braking Wrap Dispenser having U.S. Appl. No. 14/108,881, filed Dec. 17, 2013, 29 pgs.
Stanton, Christopher M.; U.S. Patent Application entitled: Braking Wrap Dispenser having U.S. Appl. No. 15/001,281, filed Jan. 20, 2016, 30 pgs.
Dahlmann, Deborah A.; Non-Final Office Action for U.S. Appl. No. 14/609,567, filed Jan. 30, 2015, dated Mar. 16, 2016, 38 pgs.
Dahlmann, Deborah A.; U.S. Patent Application entitled: Capped Wrap Dispenser having U.S. Appl. No. 14/609,567, filed Jan. 30, 2015, 31 pgs.
Dahlmann, Deborah A.; U.S. Patent Application entitled: Collared Wrap Dispenser having U.S. Appl. No. 14/642,940, filed Mar. 10, 2015, 31 pgs.
Goodwrappers; "Unitization products by Goodwrappers, include hand wrappers, replacement rolls, core handwrap, generic and disposable hand wrap", Apr. 7, 2010, located at <https://web.archive.org/web/20100407080537/http:/www.goodwrappers.com/prod_unit.asp, 4 pgs.
Images of Braking Wrap Film Dispenser, the Dispenser publicly available prior to Dec. 17, 2012, 12 pgs.
Vestil Manufacturing; "Stretch Wrap Dispensers", located at <http://www.vestilmfg.com/products/mhequip/stretch_wrap_dispensers.htm>, Copyright 2014, accessed on Aug. 11, 2014, 2 pgs.
Dahlmann, Deborah A.; Non-Final Office Action for U.S. Appl. No. 14/642,940, filed Mar. 10, 2015, dated Oct. 11, 2017, 48 pgs.
Stanton, Christopher M..; Non-Final Office Action for U.S. Appl. No. 15/001,281, filed Jan. 20, 2016, dated Jan. 11, 2017, 44 pgs.
Stanton, Christopher M.; Notice of Allowance for U.S. Appl. No. 15/001,281, filed Jan. 20, 2016, dated Mar. 8, 2017, 5 pgs.
Dahlmann, Deborah A.; Advisory Action for U.S. Appl. No. 14/609,567, filed Jan. 30, 2015, dated Jan. 24, 2017, 4 pgs.
Stanton, Christopher M.; Issue Notification for U.S. Appl. No. 15/606,361, filed May 26, 2017, dated Apr. 4, 2018, 1 pg.
Stanton, Christopher M.; Supplemental Notice of Allowance for U.S. Appl. No. 15/606,361, filed May 26, 2017, dated Mar. 22, 2018, 6 pgs.
Stanton, Christopher M.; Non-Final Office Action for U.S. Appl. No. 15/916,992, filed Mar. 9, 2018, dated May 16, 2018, 25 pgs.
Dahlmann, Deborah A.; Notice of Allowance for U.S. Appl. No. 14/642,940, filed Mar. 10, 2015, dated Apr. 2, 2018, 9 pgs.
Dahlmann, Deborah A.; Supplemental Notice of Allowance for U.S. Appl. No. 14/642,940, filed Mar. 10, 2015, dated Apr. 13, 2018, 6 pgs.
Dahlmann, Deborah; Supplemental Notice of Allowance for U.S. Appl. No. 14/642,940, filed Mar. 10, 2015, dated May 9, 2018, 6 pgs.
Rivera, William Arauz; Issue Notification for U.S. Appl. No. 14/642,940, filed Mar. 10, 2015, dated May 16, 2018, 1 pg.
Walters, Travis; Notice of Allowance for a Design Application for U.S. Appl. No. 29/596,584, filed Mar. 9, 2017, dated May 7, 2018, 40 pgs.
Walters, Travis; Issue Notification for Design U.S. Appl. No. 29/596,584, filed Mar. 9, 2017, dated Jul. 4, 2018, 1 pg.
Walters, Travis; Supplemental Notice of Allowability for Design U.S. Appl. No. 29/596,584, filed Mar. 9, 2017, dated Jun. 25, 2018, 8 pgs.
Walters, Travis; Notice of Allowance for a Design U.S. Appl. No. 29/649,781, filed Jun. 1, 2018, dated Aug. 31, 2018, 29 pgs.
Walters, Travis; Supplemental Notice of Allowance for U.S. Appl. No. 29/649,781, filed Jun. 1, 2018, dated Sep. 10, 2018, 3 pgs.
Walters, Travis; Non-Final Office Action for U.S. Appl. No. 15/454,415, filed Mar. 9, 2017, dated Oct. 5, 2018, 52 pgs.
Walters, Travis; Supplemental Notice of Allowance for Design U.S. Appl. No. 29/649,781, filed Jun. 1, 2018, dated Sep. 24, 2018, 7 pgs.

* cited by examiner

WRAP DISPENSER WITH FLAT RIM CAP

TECHNICAL FIELD

This disclosure relates to wrap dispensers. More specifically, this disclosure relates to wrap dispensers that allow an operator to dispense rolls of film or other wrap while holding onto the wrap dispenser.

BACKGROUND

Plastic or other sheets of material are sometimes used to wrap items for transport, storage, or other various reasons. For one example among others, wraps include thin plastic films, membranes, or sheets of any suitable material and are often rolled around a cylindrical paperboard core or other similar devices such as a spool made of another material that allows the wrap to be dispensed to facilitate the wrapping of items. This can protect the items from dust, water, and other contaminants found in the environment and can hold the items together. Types of plastic wraps may include plastic stretch wrap, which is commonly rolled around a paperboard core and used to secure and protect items during a move, such as wrapping furniture or bundling objects together. In many situations, this dispensing is done manually. Accordingly, it is desirable that the method of dispensing wrap is done in a safe but efficient manner.

SUMMARY

Disclosed is a dispenser comprising a rotating member including a first end and a second end, the rotating member having an inner surface and defining an axis of rotation that extends from the first end to the second end, a holding member having an inner surface, an outer holding surface, and a collar at a first end of the holding member, the inner surface enclosing an engaging portion of the rotating member, the holding member configured to rotate relative to the rotating member, and a cap attached to the first end of the rotating member and retaining the holding member on the rotating member, the collar of the holding member positioned at least partially directly between an end surface at the first end of the rotating member and a stop surface of the cap within an end gap between the end surface and the stop surface providing clearance for the collar.

Also disclosed is a method of assembling a wrap dispenser comprising sliding a holding member onto the engaging portion of a rotating member, and inserting an insertion portion of a cap through a collar of the holding member and into a first end of the rotating member, the insertion portion frictionally engaging an inner surface of the rotating member, at least a portion of the collar retained between an end surface at the first end of the rotating member and a stop surface of a rim of the cap.

Also disclosed is a method of dispensing wrap from a roll using a dispenser, the method comprising gripping onto an outer holding surface of a holding member of the dispenser, the holding member enclosing an engaging portion of a rotating member of the dispenser, the dispenser further including wrap wrapped around a roll-holding portion of the rotating member, and a cap attached to the first end of the rotating member and holding the holding member with a collar of the holding member positioned at least partially directly between an end surface at the first end of the rotating member and a stop surface of the cap within an end gap between the end surface and the stop surface providing clearance for the collar, and dispensing the wrap by rotating the rotating member relative to the holding member.

Various implementations described in the present disclosure may include additional systems, methods, features, and advantages, which may not necessarily be expressly disclosed herein but will be apparent to one of ordinary skill in the art upon examination of the following detailed description and accompanying drawings. It is intended that all such systems, methods, features, and advantages be included within the present disclosure and protected by the accompanying claims.

BRIEF DESCRIPTION OF THE DRAWINGS

The features and components of the following figures are illustrated to emphasize the general principles of the present disclosure. Corresponding features and components throughout the figures may be designated by matching reference characters for the sake of consistency and clarity.

DETAILED DESCRIPTION

Figure 1:
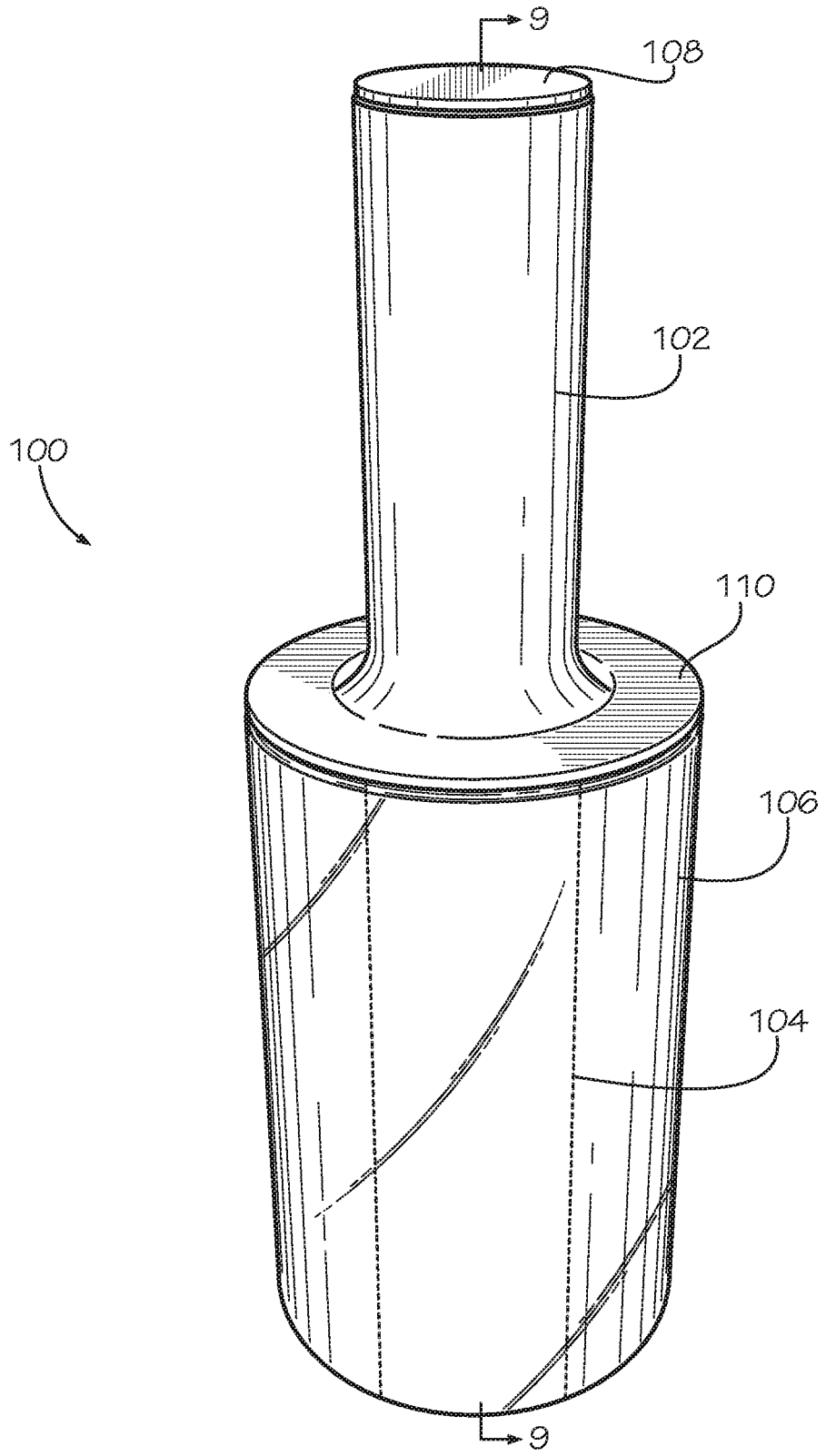
FIG. 1 is a perspective view of a wrap dispenser according to a first embodiment of the present disclosure including a holding member, a rotating member, and a cap.

The present disclosure can be understood more readily by reference to the following detailed description, examples, drawings, and claims, and the previous and following description. However, before the present devices, systems, and/or methods are disclosed and described, it is to be understood that this disclosure is not limited to the specific devices, systems, and/or methods disclosed unless otherwise specified, and, as such, can, of course, vary. It is also to be understood that the terminology used herein is for the purpose of describing particular aspects only and is not intended to be limiting.

The following description is provided as an enabling teaching of the present devices, systems, and/or methods in their best, currently known embodiments. To this end, those skilled in the relevant art will recognize and appreciate that many changes can be made to the various aspects described herein, while still obtaining the beneficial results of the present disclosure. It will also be apparent that some of the desired benefits of the present disclosure can be obtained by selecting some of the features of the present disclosure without utilizing other features. Accordingly, those who work in the art will recognize that many modifications and adaptations to the present disclosure are possible and can even be desirable in certain circumstances and are a part of the present disclosure. Thus, the following description is provided as illustrative of the principles of the present disclosure and not in limitation thereof.

As used throughout, the singular forms "a," "an" and "the" include plural referents unless the context clearly dictates otherwise. Thus, for example, reference to "an element" can comprise two or more such elements unless the context indicates otherwise.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

For purposes of the current disclosure, a material property or dimension measuring about X or substantially X on a particular measurement scale measures within a range between X plus an industry-standard upper tolerance for the specified measurement and X minus an industry-standard lower tolerance for the specified measurement. Because tolerances can vary between different materials, processes and between different models, the tolerance for a particular measurement of a particular component can fall within a range of tolerances.

As used herein, the terms "optional" or "optionally" mean that the subsequently described event or circumstance can or cannot occur, and that the description includes instances where said event or circumstance occurs and instances where it does not.

The word "or" as used herein means any one member of a particular list and also includes any combination of members of that list. Further, one should note that conditional language, such as, among others, "can," "could," "might," or "can," unless specifically stated otherwise, or otherwise understood within the context as used, is generally intended to convey that certain aspects include, while other aspects do not include, certain features, elements and/or steps. Thus, such conditional language is not generally intended to imply that features, elements and/or steps are in any way required for one or more particular aspects or that one or more particular aspects necessarily include logic for deciding, with or without user input or prompting, whether these features, elements and/or Steps are included or are to be performed in any particular embodiment.

Disclosed are components that can be used to perform the disclosed methods and systems. These and other components are disclosed herein, and it is understood that when combinations, subsets, interactions, groups, etc. of these components are disclosed that while specific reference of each various individual and collective combinations and permutation of these may not be explicitly disclosed, each is specifically contemplated and described herein, for all methods and systems. This applies to all aspects of this application including, but not limited to, steps in disclosed methods. Thus, if there are a variety of additional steps that can be performed it is understood that each of these additional steps can be performed with any specific embodiment or combination of embodiments of the disclosed methods.

Disclosed is a wrap dispenser and associated methods, systems, devices, and various apparatus. In various embodiments, the dispenser includes at least one holding member and one rotating member that are joined in a rotatable fashion so that the rotating member may rotate while wrapped with wrap while the user holds the holding member. The terms "holding member" and "rotating member" may include any member that allows a user to, respectively, hold the holding member in the user's hand and allow the rotating member to freely rotate relative to the holding member. Furthermore, the term "wrap" should be interpreted broadly and should be applied to any material that is used to cover or protect objects, including but not limited to stretch wrap, film, bubble wrap, tape, foil, tissue paper, or wrapping paper. While it is particularly useful in applications for dispensing plastic film, sheets, or other wraps, it should not be so limited as it could be used with other dispensing operations or with other materials of any desired thickness that is used to cover, enclose, enwrap, or otherwise protect articles. It would be understood by one of skill in the art that the disclosed dispenser is described in but a few exemplary embodiments among many. No particular terminology or description should be considered on the disclosure or the scope of any claims issuing therefrom.

One embodiment of a wrap dispenser 100 is shown in FIG. 1. The wrap dispenser 100 includes a holding member 102, a rotating member 104 having a roll of wrap 106 positioned over at least a part of the rotating member 104, and a cap 108. In various embodiments, the wrap 106 is typically rolled around the rotating member 104 to create the roll of wrap 106 shown in FIG. 1. The rotating member 104 is thereby a spool around which the wrap 106 is rolled. In various embodiments, the rotating member 104 and holding member 102 are substantially annular or tubular and are separate components, though other shapes may be present in various embodiments. In the current embodiment, the rotating member 104 and holding member 102 are both right cylinders having circular ends. As shown in FIG. 1, the holding member 102 includes a flange 110.

Figure 2:
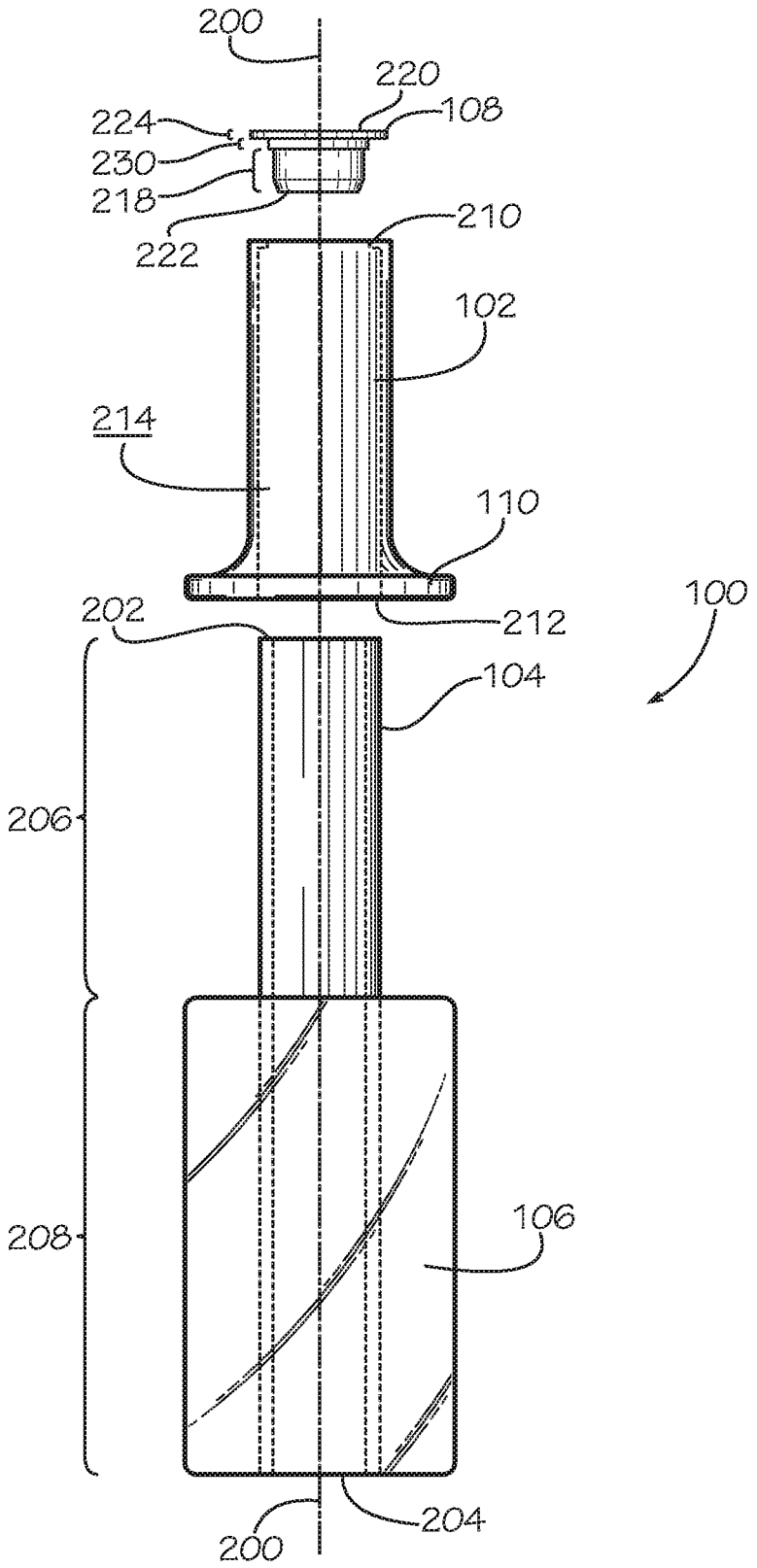
FIG. 2 is an exploded assembly view of the wrap dispenser of FIG. 1 showing how the rotating member, holding member, and a cap of the wrap dispenser are assembled.

As shown in FIG. 2, in the current embodiment, the wrap dispenser 100 includes the holding member 102, the rotating member 104 having a roll of wrap 106, and the cap 108. In the embodiment shown, the cap 108 is a flat rim cap. The wrap dispenser 100 defines a central axis 200 along which the various components of the wrap dispenser 100 are substantially aligned.

The rotating member 104 defines a first end 202 and a second end 204 as well as an engaging portion 206 and a roll-holding portion 208. In various embodiments, the first end 202 defines a continuous unbroken circle and the second end 204 defines a continuous unbroken circle. In various embodiments, the rotating member 104 is a continuous cylinder such that the cross-section of the rotating member 104 is consistently circular and unbroken from end-to-end with no cuts, slots, or holes therethrough. As shown in FIG. 2, the roll of wrap 106 is positioned on the roll-holding portion 208 of the rotating member 104. The rotating member 104 will be described in greater detail below with reference to FIG. 3.

The wrap dispenser 100 also includes the holding member 102, which is configured to slide onto the engaging portion 206 of the rotating member 104 in the assembled dispenser 100. The holding member 102 has a first end 210 and a second end 212 and defines an outer holding surface 214 that a user may hold, grab, or clench when using the wrap dispenser 100 to dispense wrap 106 such as film. In various embodiments, the first end 210 defines a continuous unbroken circle and the second end 212 defines a continuous unbroken circle. As shown in FIG. 2, in various embodiments the flange 110 is positioned on the holding member 102 at the second end 212. In various other embodiments, the flange 110 may be positioned at an intermediary position between the first end 210 and the second end 212. The flange 110 may have an annular shape with a thickness along the axis of rotation 200 and may extend radially in a direction that is perpendicular to the axis of rotation 200 to give the flange 110 a diameter that is greater than a diameter of the first end 210. The holding member 102 will be described in greater detail below with reference to FIGS. 6 and 7. In various other embodiments the flange 110 may be a separate component from the holding member 102, such as an enlarged washer between the holding member 102 and the wrap 106.

The dispenser 100 further includes the cap 108. The cap 108 defines a rim portion 224, a shoulder portion 230, and an insertion portion 218. As shown in FIG. 2, the cap 108 has a first end 220 and a second end 222. The cap 108 will be described below in greater detail with reference to FIGS. 4 and 5.

Figure 3:
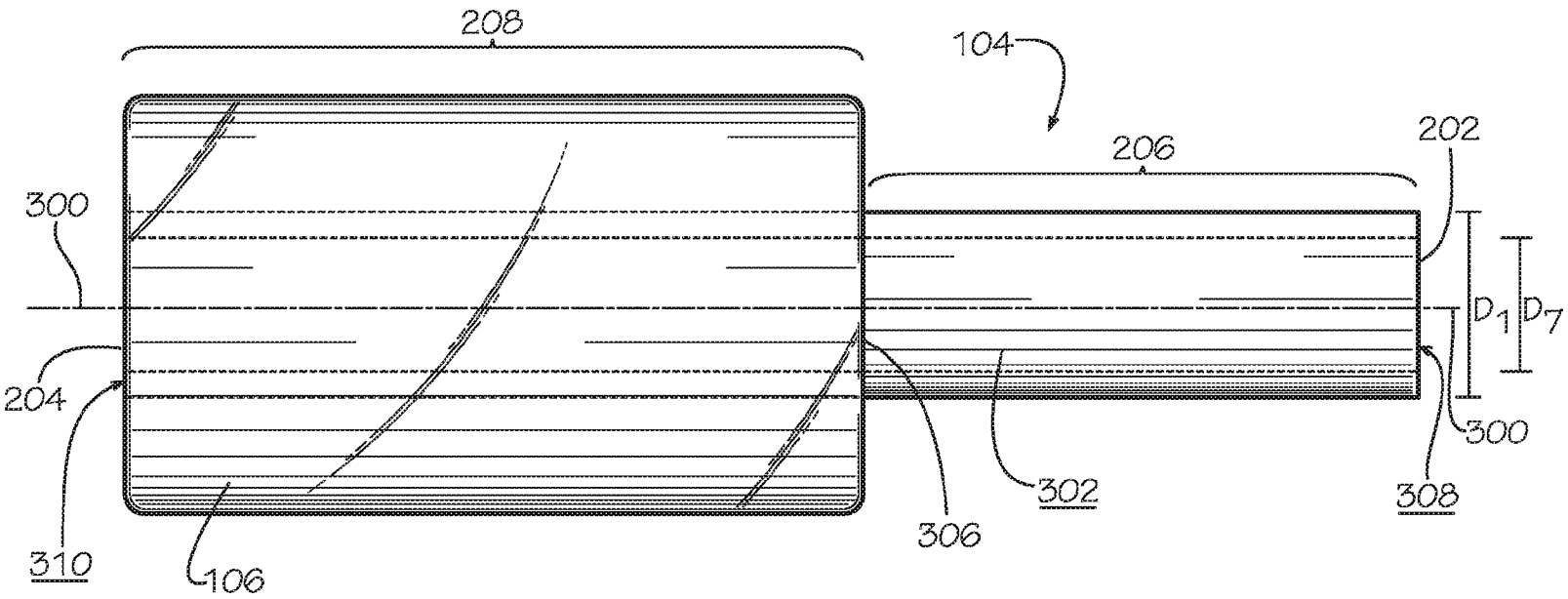
FIG. 3 is a side view of the rotating member of the wrap dispenser of FIG. 1.

As shown in FIG. 3, the rotating member 104 has a substantially annular or tubular configuration in the current embodiment. Consequently, in the current embodiment, the rotating member 104 has an outer diameter $D_1$ and an inner diameter $D_7$. The rotating member 104 also has a longitudinal axis which is the axis of rotation 300 that extends from its first end 202 to its second end 204. The rotating member 104 also includes an outer surface 302, an inner surface 304 (shown in FIGS. 9A-B), a first end surface 308, and a second end surface 310. In various embodiments, the inner surface 304 and the outer surface 302 are smooth surfaces that are substantially cylindrical. In various embodiments, the outer surface 302 defines the outer diameter $D_1$ and the inner surface 304 defines the inner diameter $D_7$.

As shown FIG. 3, the rotating member 104 includes the engaging portion 206 and the roll-holding portion 208. The engaging portion 206 is generally the area of the outer surface 302 from the first end 202 to some intermediary position 306 on the outer surface 302 of the rotating member 104 over which the holding member 102 will be positioned and a user can grasp the dispenser 100. The roll-holding portion 208 is generally the area of the outer surface 302 from the second end 204 to the intermediary position 306 on the outer surface 302 of the rotating member 104 over which the roll of wrap 106 will be positioned on the rotating member 104. In the present embodiment, the longitudinal length of the roll-holding portion 208 is greater than the longitudinal length of the engaging portion 206. However, in various other embodiments, the longitudinal length of the engaging portion 206 may be equal to or greater than the longitudinal length of the roll-holding portion 208.

In various embodiments, the outer surface 302 of the rotating member 104 in the engaging portion 206 interacts with an inner surface 216 (shown in FIG. 7) of the holding member 102, which will be described in further detail below. In the current embodiment, the roll-holding portion 208 of the rotating member 104 is substantially cylindrical and the outer surface 302 in the roll-holding portion 208 is a smooth surface. In various other embodiments, the roll-holding portion 208 of the rotating member 104 includes at least one roll grip on the outer surface 302. In these embodiments, the at least one roll grip is a rib or a raised surface protruding radially outward from the outer surface 302 on the roll-holding portion 208 of the rotating member 104. In these embodiments, the at least one roll grip engages the inside of the roll of wrap 106 in a frictionally desirable manner to help keep the roll of wrap 106 from falling off the dispenser 100.

In the current embodiment, rotating member 104 is constructed from paperboard and the inner surface 304 is a smooth cylindrical surface. In various embodiments where the dispenser 100 includes the cap 108, when assembled, the cap 108 is biased against the inner surface 304 of the rotating member 104 such that the cap 108 provides an interference fit with the inner surface 304 of the rotating member 104. In the current embodiment, the cap 108 is rotationally fixed to the rotating member 104. In various other embodiments, the cap 108 includes attachment mechanisms or connecting mechanisms such as ribs, threading, grooves, fasteners, adhesives, or various other connecting mechanisms to engage the inner surface 304. In various other embodiments, the inner surface 304 includes attachment mechanisms or connecting mechanisms positioned on the inner surface 304 proximate to the first end 110, on the outer surface 302 proximate to the first end 110, or on both the inner surface 304 and outer surface 302 proximate to the first end 110 to engage the cap 108.

Figure 4:
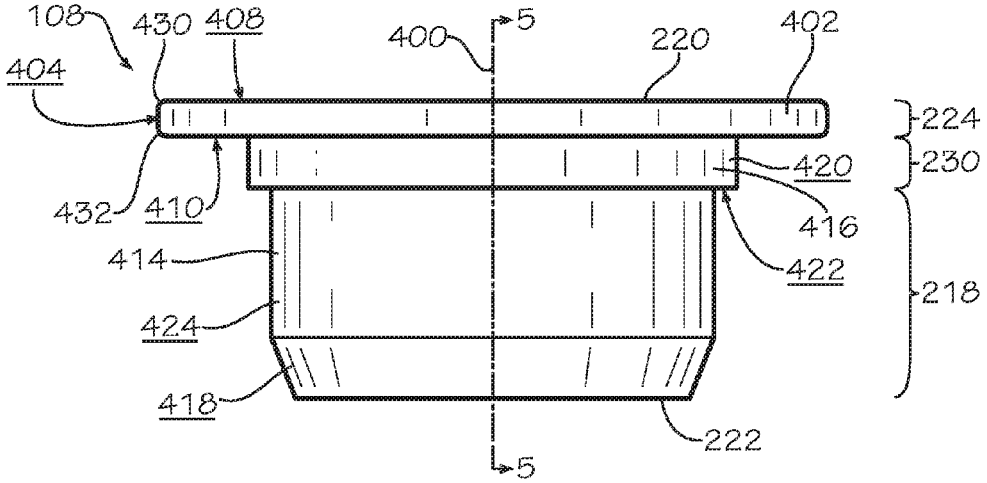
FIG. 4 is a side view of the cap of FIG. 1.

FIG. 4 shows a side view of the cap 108. In this embodiment, the cap 108 is a flat rim cap. The cap 108 defines a center axis 400 and includes the rim portion 224, the shoulder portion 230, and the insertion portion 218. The rim portion 224 is defined by a rim 402 positioned at the first end 220. The rim 402 has a thickness along the center axis 400 and extends radially outward from the center axis 400. In the embodiment shown, the rim 402 is a substantially flat rim. The rim 402 defines an outer surface 408 distal from the second end 222, a side surface 404 on the circumference of the rim 402, and a stop surface 410 facing the second end 222. In the embodiment shown in FIG. 4, the intersections between the outer surface 408 and the side surface 404 defines a curved transition 430, and the intersection between side surface 404 and the stop surface 410 defines a curved transition 432. In some other embodiments, the transitions between the surfaces may define by a sharp corner, a rounded corner, or a chamfer.

The shoulder portion 230 of the cap 108 is defined by a shoulder 416 which is positioned between the rim portion 224 and the insertion portion 218. The shoulder 416 may be annular and extend around the entire circumference of the cap 108; however, in other embodiments, the shoulder 416 may not be annular and may not extend around the entire circumference of the cap 108. The axially-outer surface of the shoulder 416 defines a vertical surface 420 which is coaxial with the side surface 404 of the rim 402. The shoulder 416 additionally defines a horizontal surface 422 which lies in a plane normal to the center axis 400. In the embodiment shown in FIG. 4, an intersection between the vertical surface 420 and the horizontal surface 422 forms a corner, though in other embodiments, the intersection between these surfaces may define a rounded or chamfered transition surface. With the cap 108 installed in the rotating member 104, a portion of the horizontal surface 422 abuts a portion of a first end surface 308 of the first end 202.

As shown in FIG. 4, the insertion portion 218 comprises a circumferential wall 414 extending from the shoulder 416 to the second end 222. The circumferential wall 414 defines an outer surface 424. In various embodiments, as shown in FIG. 4, the inner circumferential wall 414 also has a tapered surface 418 defined by a chamfer between the second end 222 and the outer surface 424. In other embodiments, the tapered surface 418 may be defined by a bevel or a rounded transition surface. The tapered surface 418 is configured to aid in insertion of the cap 108 into an opening defined by the first end 202 of the rotating member 104. In other embodiments, the insertion portion 218 may be substantially longer or shorter than the embodiment shown in FIG. 4.

Figure 5:
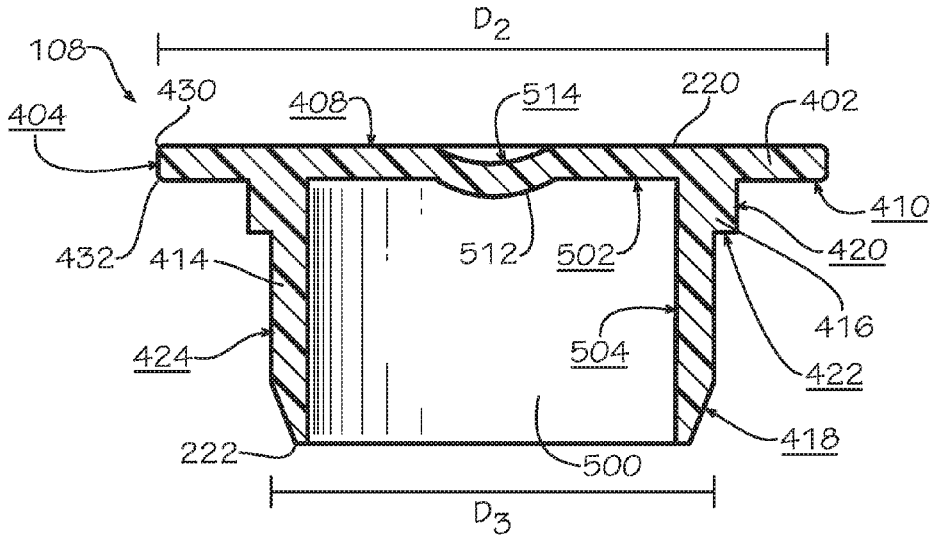
FIG. 5 is a cross-sectional view of the cap of FIG. 4 taken along line 5-5.

FIG. 5 shows a cross-sectional view of cap 108 taken along line 5-5 in FIG. 4. As shown in FIG. 5, in various embodiments, the inner circumferential wall 414 defines a cavity 500 extending inward from the second end 222 into the insertion portion 218 and the shoulder portion 230. In various embodiments, cavity 500 extends partially into the rim portion 224 or the shoulder portion 230. In various embodiments, the cavity 500 includes a bottom surface 502 and a cylindrical inner surface 504 extending from the bottom surface 502 to the second end 222. As shown in FIG. 5, in various embodiments, the cap 108 includes a dimple 512 on the bottom surface 502 and protruding into the cavity 500. In embodiments where the cap 108 includes the dimple 512, the outer surface 408 of the cap 108 may define a recessed surface 514 corresponding to the location of the dimple 512. In other embodiments, the cap 108 may be solid in cross-section without defining a cavity.

In various embodiments, the cap 108 has a generally circular shape with an outermost diameter $D_2$ of the rim 402 defined by the side surface 404. In the embodiment shown, the outermost diameter $D_2$ is sized to be slightly smaller than a diameter $D_4$ of the holding member 102 (see FIG. 6). This can be desirable to prevent substantial contact between the rim 402 and a user's hand since the cap 108 rotates with the rotating member 104 relative to the holding member 102. In other embodiments, the diameter $D_2$ may be equal to or greater than the diameter $D_4$. The cap 108 also has a diameter $D_3$ defined by the outer surface 424 of the circumferential wall 414. The diameter $D_3$ of the cap 108 is sized relative to inner diameter $D_7$ of the rotating member 104 (see FIG. 3) to provide an interference fit which secures the cap 108 to the rotating member 104. The shape of the cap 108 should not be considered limiting on the current disclosure as in various other embodiments, the cap 108 may be square, oval, angled, or have any other desired shape.

Figure 6:
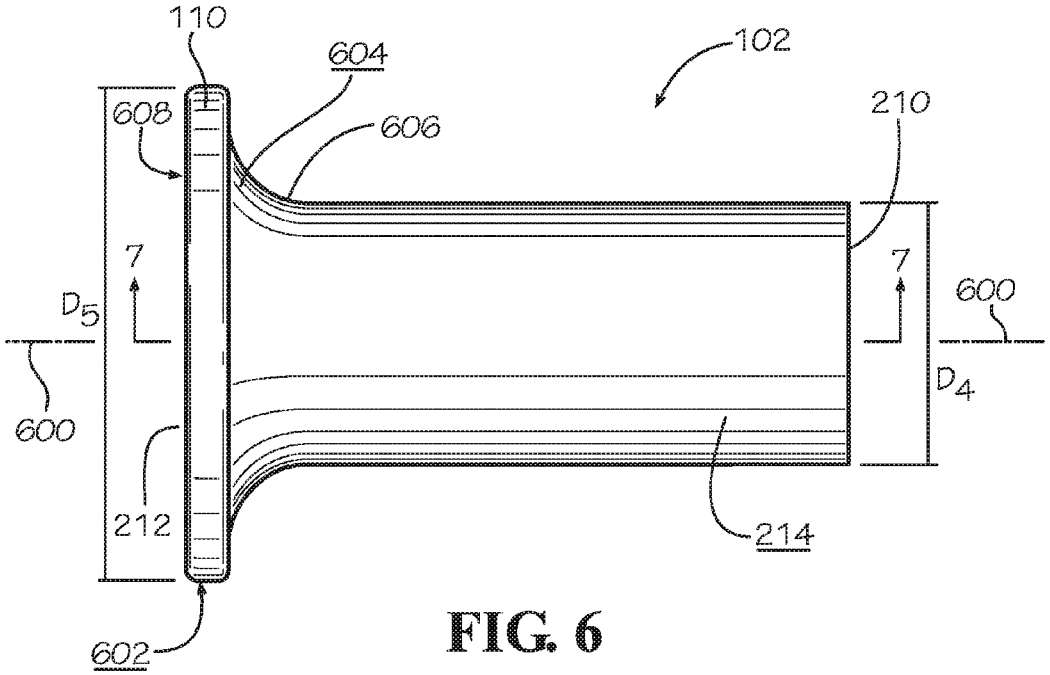
FIG. 6 is a side view of the holding member of FIG. 1.

As shown in FIG. 6, the holding member 102 has a substantially annular or tubular configuration with a longitudinal axis 600 that extends from its first end 210 to its second end 212. The holding member 102 includes the outer holding surface 214 and an inner surface 216 (shown in FIG. 7). As shown in FIG. 6, the outer holding surface 214 defines the diameter $D_4$. In various embodiments, the first end 210 defines a continuous unbroken circle and the second end 212 defines a continuous unbroken circle.

The holding member 102 also includes the flange 110. When a user is holding the holding member 102, the flange 110 may protect the user's hand from the roll of wrap 106. In various embodiments, the flange 110 is integrally formed with the holding member 102; however in various other embodiments, the flange 110 is attached or otherwise connected to the holding member 102 with mechanisms including, but not limited to, welding, adhesives, glues, fasteners, or various other attachment mechanisms. In the present embodiment, the flange 110 has an annular shape. In various embodiments, the flange 110 defines a continuous unbroken circle. In various other embodiments, the flange 110 may have a shape that is square, oval, angled, or have any other desired shape. The shape of the flange 110 should not be considered limiting on the current disclosure. In various embodiments, the flange 110 is positioned at the second end 212 of the holding member 102; however, the location of the flange 110 should not be considered limiting as in various other embodiments, the flange is positioned at some intermediary position between the second end 212 and the first end 210.

The flange 110 has a thickness along the axis 600 and extends radially outwards from the outer holding surface 214 in a direction that is perpendicular to the axis 600 to give the flange 110 an outer diameter $D_5$ that is greater than the diameter $D_4$ of the outer holding surface 214. As shown in FIG. 6, the flange 110 defines a side flange surface 602 and an end flange surface 608. In various embodiments, the end flange surface 608 defines the roll-side surface of the second end 212 of the holding member 102. In various embodiments, the holding member 102 defines an edge surface 604 between the side flange surface 602 and an intermediary position 606 on the outer holding surface 214. In various embodiments, the edge surface 604 is curved or rounded; however, in various other embodiments, the edge surface 604 is square, angled, rounded, or have any other desired edge shape. The shape of the edge surface 604 should not be considered limiting on the current disclosure. As previously described, the user may hold, grab, or clench the outer holding surface 214 when using the wrap dispenser 100 to dispense wrap such as film.

Figure 7:
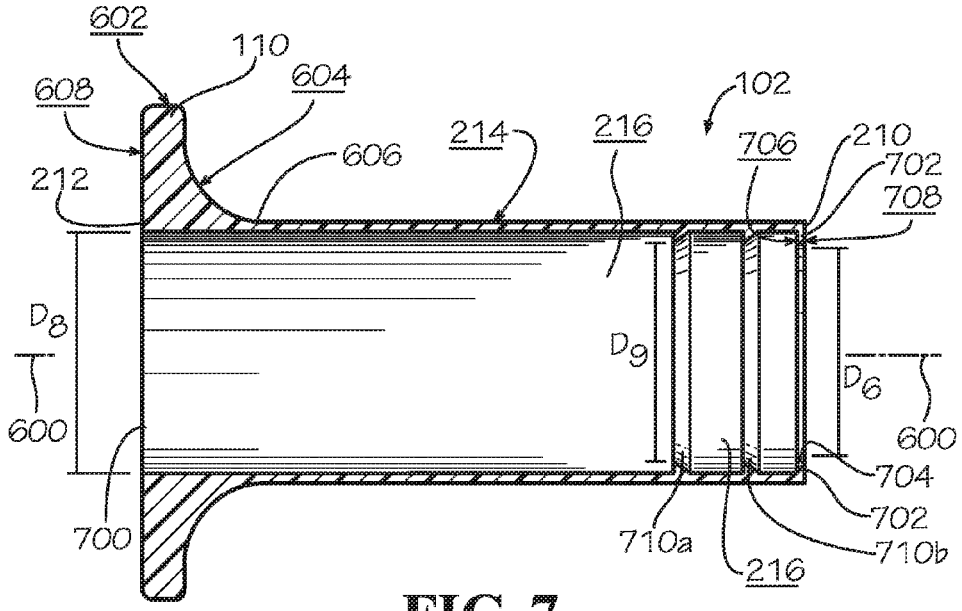
FIG. 7 is a cross-sectional view of the holding member of FIG. 6 taken along line 7-7.

As shown in FIG. 7, the inner surface 216 defines a diameter $D_8$, which is greater than rotating member diameter $D_1$ and less than the diameter $D_4$ of the outer holding surface 214. In the current embodiment, the inner surface 216 is substantially cylindrical. In the embodiment shown in FIG. 7, the inner surface 216 defines a pair of circumferential ribs 710*a,b* which extend radially inward. The radially innermost edge of the circumferential ribs 710*a,b* has diameter $D_9$. In the embodiment shown, diameter $D_9$ is sized larger than the outer diameter $D_1$ of the outer surface 302 of the rotating member 104 which provides clearance for the rotating member 104 to smoothly rotate relative to the holding member 102. In other embodiments, the inner surface may define greater or fewer than two circumferential ribs 710. The circumferential ribs 710*a,b* are positioned proximate the first end 210. The circumferential ribs 710*a,b* aid in centering the first end 202 of the rotating member 104 relative to the first end 210 of the holding member 102. The embodiment shown in FIG. 7 has circumferential ribs 710*a,b* with a triangular cross-section; however, in other embodiments, the circumferential ribs 710*a,b* may have a cross-section that is rectangular, semi-circular, or any other shape. In the embodiment shown, the circumferential ribs 710*a,b* extend around the entire circumference of the inner surface 216, but in other embodiments, the circumferential ribs 710*a,b* may only extend partially around the circumference of the inner surface 216. In some embodiments, a plurality of protuberances such as nubs or tabs may be used in place of circumferential ribs.

As described below, in various embodiments, the inner surface 216 can frictionally engage the engaging portion 206 of the rotating member 104 upon compression of the holding member 102. In various other embodiments, the inner surface 216 can define additional structures protruding radially inwardly from the inner surface 216. These structures may include nubs, circumferential ridges, longitudinal ridges, teeth, or similar protrusions configured to enhance the friction produced when compressing the holding member 102 to engage the engaging portion 206 of the rotating member 104.

In various embodiments, the inner surface 216 defines a second end opening 700 at the second end 212 through which the rotating member 104 is positioned such that the outer surface 302 of the engaging portion 206 of the rotating member 104 faces the inner surface 216. In various embodiments, the second end opening 700 has a diameter of $D_8$.

In various embodiments, holding member 102 includes a collar 702 at the first end 210. In various embodiments, the collar 702 defines a continuous unbroken circle. The collar 702 has a thickness along the axis 600 and extends radially inwards from the inner surface 216 in a direction that is perpendicular to the axis 600. The collar 702 has an inner surface 706 and an outer surface 708. When the wrap dispenser 100 is assembled, the outer surface 708 faces the rim 402 of the cap 108 while the inner surface 706 faces the first end 202 of the rotating member 104 (shown in FIGS. 9A-9B). In various embodiments, the collar 702 is integrally formed with the holding member 102; however, in various other embodiments, the collar 702 is attached to the holding member 102 with attachment mechanisms including, but not limited to, welding, adhesives, glues, fasteners, or various other attachment mechanisms.

As shown in FIG. 7, the collar 702 defines a first end opening 704 with a diameter $D_6$ that is less than the diameter $D_8$ of the inner surface 216. In various embodiments, the diameter $D_6$ of the first end opening 704 is greater than the inner diameter $D_7$ of the rotating member 104 but less than the outer diameter $D_1$ of the rotating member 104 (see FIG. 3). The diameter $D_6$ of the first end opening 704 of the holding member 102 is also greater than the diameter $D_3$ of the outer surface 424 of the cap 108 but less than the outermost diameter $D_2$ of the rim 402 (see FIG. 5). As will be described below, when the dispenser 100 is assembled, at least a portion of the insertion portion 218 of the cap 108 is inserted through the first end opening 704.

Figure 8:
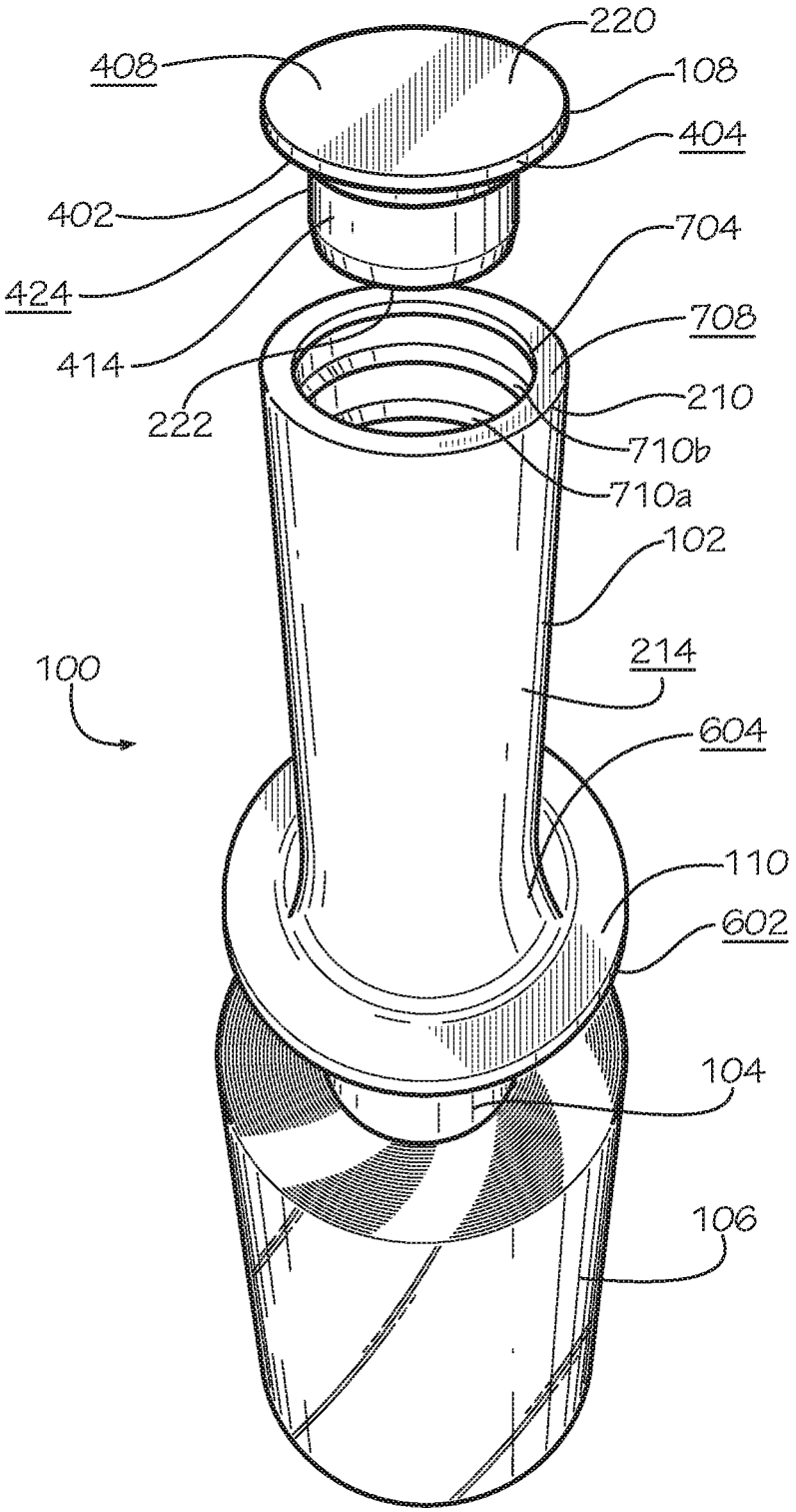
FIG. 8 is a partially-exploded perspective view of a wrap dispenser of FIG. 1.

FIG. 8 shows the wrap dispenser 100 with the holding member 102, the rotating member 104 having the roll of wrap 106, and the cap 108. As shown in FIG. 8, in various embodiments, the holding member 102 is positioned on the rotating member 104 such that the flange 110 is positioned adjacent to the roll of wrap 106. In these embodiments, the end flange surface 608 (shown in FIGS. 6 and 7) abuts the roll of wrap 106 when the dispenser 100 is fully assembled. The circumferential ribs 710*a,b* can be seen through the first end opening 704.

Figure 9A:
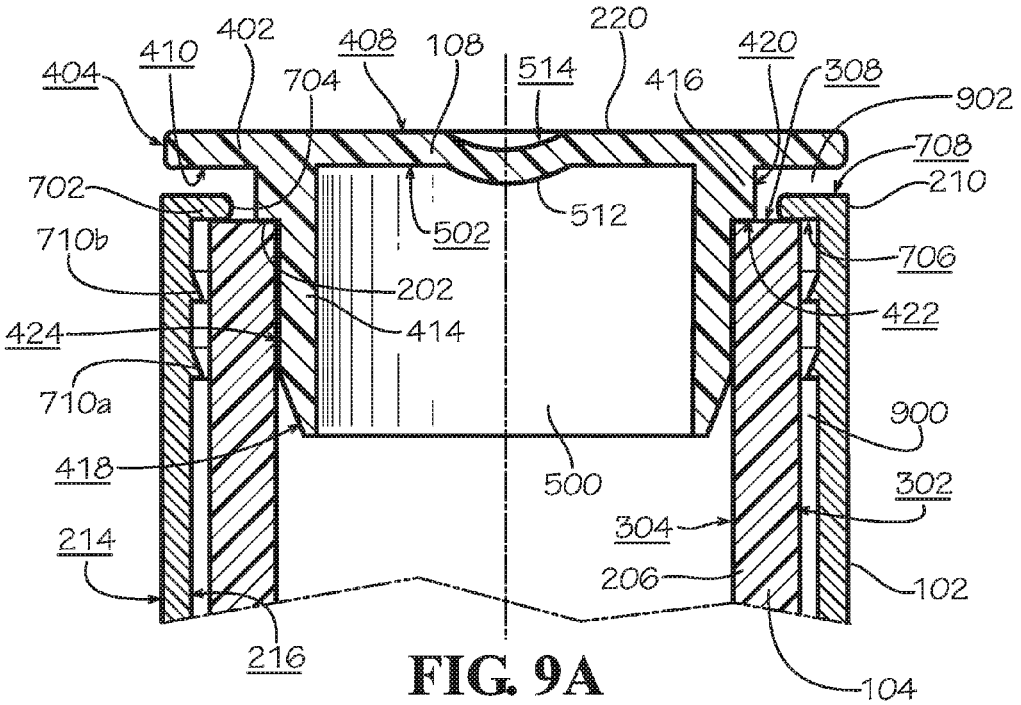
FIGS. 9A and 9B are partial cross-sectional views of the cap, holding member, and rotating member of FIG. 1 taken along line 9-9 of FIG. 1.
Figure 9B:
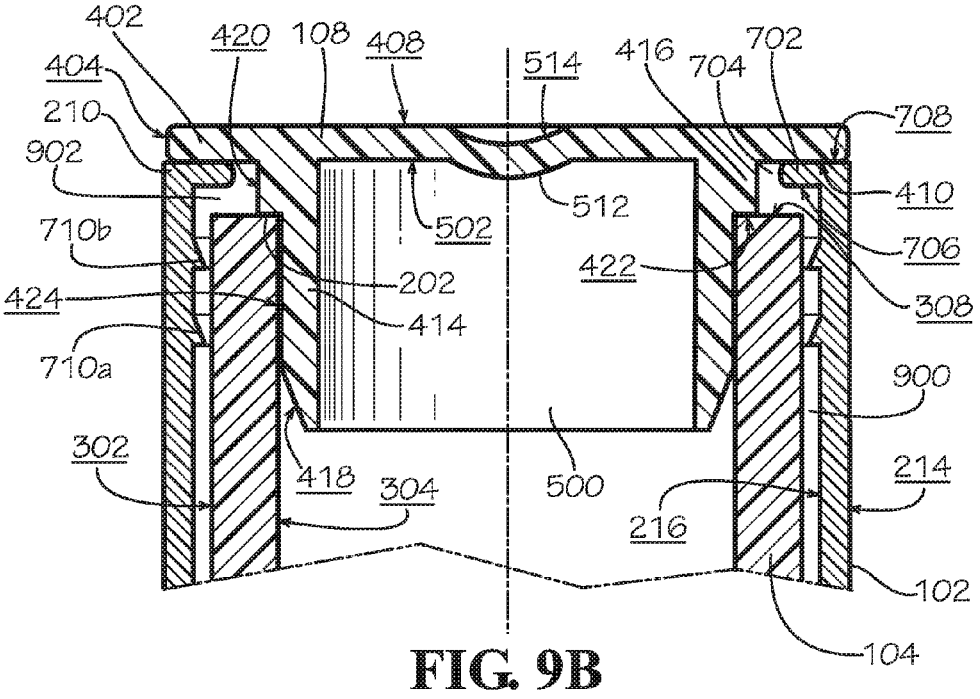

As shown in FIGS. 9A-B, when the circumferential wall 414 of the insertion portion 218 of the cap 108 is inserted through the first end opening 704 of the holding member 102 and into the rotating member 104, the outer surface 424 of the circumferential wall 414 is positioned adjacent to and in contact with the inner surface 304 of the rotating member 104 such that the outer surface 424 frictionally engages the inner surface 304 upon insertion of the cap 108 and provides an interference fit. In various embodiments, this is accomplished by sizing the circumferential wall 414 such that the circumferential wall 414 is biased against and presses into the inner surface 304 of the rotating member 104 but is not too tight to pull the cap 108 away from the rotating member 104 with sufficient force by hand. In various embodiments, diameter $D_3$ of the cap 108 is approximately equal to or greater than diameter $D_7$ of the inner surface 304 such that the cap 108 stays attached to the rotating member 104. In various other embodiments, the cap 108 is permanently engaged or attached to the rotating member 104. The cap 108 may also engage the rotating member 104 through various attachment mechanisms such as those in the group including, but not limited to, threading, ribs, adhesives, fasteners, or various other attachment mechanisms.

In various embodiments, once the cap 108 is attached to the rotating member 104, the cap 108 prevents or resists removal of the holding member 102 from the rotating member 104 over the first end 202 of the rotating member 104. In various embodiments, tapered surface 418 aids in introducing circumferential wall 414 of the insertion portion 218 into the rotating member 104. In various embodiments where diameter $D_3$ of the cap 108 is greater than diameter $D_7$ of the inner surface 304, tapered surface 418 makes it possible to insert the insertion portion 218 of the cap 108 into the rotating member 104. Interference between the horizontal surface 422 of the shoulder 416 and the first end surface 308 of the rotating member 104 limit how far the plug 108 can be inserted into the first end 202 of rotating member 104. With the insertion portion 218 fully inserted into the first end 202 of the rotating member 104, the shoulder 416 rests against the first end surface 308.

In various embodiments, when the cap 108 is attached to the rotating member 104, the cap 108 abuts the holding member 102 and, in combination with the wrap 106, captures and holds the holding member 102 on the rotating member 104 between the cap 108 and the wrap 106. In the current embodiment, the cap 108 retains the holding member 102 on the rotating member 104 by capturing the collar 702 between the rim 402 of the cap 108 and the first end 202 of the rotating member 104. The holding member 102 is configured to rotate relative to the rotating member 104. As shown in FIG. 9A, interference between the inner surface 706 of the collar 702 of the holding member 102 with the first end surface 308 of the rotating member 104 prevents the holding member 102 from sliding completely over the first end 202 of the rotating member 104. In some embodiments, this interference between the collar 702 and the first end 202 of the rotating member 104 allows clearance to be maintained between the flange 110 of the holding member and the wrap 106. Clearance between the flange 110 and the wrap 106 can be desirable to allow the rotating member 104 to rotate more easily relative to the holding member 102. In some embodiments, slidably positioning the holding member 102 on the rotating member 104 allows the inner surface 706 to frictionally engage the first end surface 308 by directly contacting and engaging the first end surface 308, thereby increasing friction between the surfaces 706, 308. In various embodiments, the inner surface 706 can contact the first end surface 308 of the rotating member 104 such that the holding member 102 is slidable against the rotating member 104.

As shown in FIG. 9B, interference between the outer surface 708 of the collar 702 and the stop surface 410 of the rim 402 prevents the holding member 102 from sliding off of the rotating member 104. In the embodiment shown in FIG. 9A-9B, the sizing of the vertical surface 420 of the shoulder 416 relative to the axial thickness of the collar 702 provides an end gap 902 to ensure free rotation and prevent binding of the rotating member 104 relative to the holding member 102. In FIG. 9A, the end gap 902 is shown between the stop surface 410 of the rim 402 and the outer surface 708 of the collar 702. In FIG. 9B, the end gap 902 is shown between the inner surface 706 of the collar 702 and the first end surface 308 of the rotating member 104. FIG. 9A and FIG. 9B represent the extreme positions of the holding member 102 relative to the cap 108 and the rotating member 104. In use, the holding member 102 can freely slide between these extremes and frequently will be disposed between these positions with end gaps 902 on both the inner surface 706 and outer surface 708 of the collar 702.

As shown in FIGS. 9A and 9B, a clearance gap 900 exists between the inner surface 216 of the holding member 102 and the outer surface 302 of the rotating member 104. This clearance gap 900 prevents binding and allows smooth rotation of the rotating member 104 relative to the holding member 102. In the embodiment shown, the circumferential ribs 710*a,b* protrude radially inwards from the inner surface 216, thereby reducing the clearance gap 900 at the circumferential ribs 710*a,b*. However, the circumferential ribs 710*a,b* do not eliminate the clearance gap 900 as clearance still exists between the circumferential ribs 710*a,b* and the outer surface 302. The diameter $D_9$ of the innermost edge of the circumferential ribs 710*a,b* is sized to be larger than the outer diameter $D_1$ of the outer surface 302 to provide clearance and maintain the clearance gap 900. The circumferential ribs 710*a,b* aid in axially centering the first end 210 of the holding member 102 on the first end 202 of the rotating member 104. In other embodiments, an axial-centering effect can be provided by sizing a diameter of the vertical surface 420 of the shoulder 416 of the cap 108 relative to the diameter $D_6$ of the first opening 704 of the collar 702 to provide minimal clearance. In other embodiments, the holding member 102 may be axially-centered on the rotating member 104 by sizing the diameter $D_8$ of the inner surface 216 of the holding member 102 to closely match the outer diameter $D_1$ of the outer surface 302 of the rotating member 104.

Referring back to FIGS. 2-8, a method of assembling the dispenser 100 is described in further detail. It should be noted that any of the steps of any of the methods described herein may be performed in any order or could be performed in sub-steps that are done in any order or that are separated in time from each other by other steps or sub-steps, and the disclosure of a particular order of steps should not be considered limiting on the current disclosure. A rotating member 104 with a roll-holding portion 208, an engaging portion 206, an axis of rotation 300, and a roll of wrap 106 positioned on the roll-holding portion 208 is initially provided. The wrap 106 is typically wrapped around the rotating member 104 during the manufacturing process to form the roll of wrap 106 positioned on the rotating member 104.

A holding member 102 with a longitudinal axis 600 is positioned on the rotating member 104. The holding member 102 and rotating member 104 both have substantially cylindrical shapes, which gives the user ease of rotating the wrap dispenser 100 when assembled, ease of rotating contact between the holding member 102 and rotating member 104, ease of insertion of the rotating member 104 into the holding member 102, ease of gripping the holding member 102, ease of construction of the wrap dispenser 100, and various other benefits.

The holding member 102 encloses the engaging portion 206 of the rotating member 104 and the longitudinal axis 600 is substantially aligned with the axis of rotation 300. In particular, in the current embodiment, when the holding member 102 encloses the rotating member 104, the inner surface 216 of the holding member 102 is positioned adjacent to the outer surface 302 of the rotating member 104. Furthermore, when the holding member 102 is fully positioned onto the rotating member 104, the second end 212 is positioned adjacent to roll of wrap 106. In various embodiments where the holding member 102 includes the flange 110 at the second end 212, the holding member 102 is positioned with the end flange surface 608 adjacent to the roll of wrap 106. In various embodiments where the holding member 102 includes the collar 702 at the first end 210, the holding member 102 is positioned on the rotating member 104 with at least a part of the inner surface 706 of the collar 702 at least adjacent to the first end surface 308 of the rotating member 104. In various embodiments, the inner surface 706 contacts and engages the first end surface 308 and the collar 702 may rest on the first end surface 308.

The cap 108 is attached proximate to the first end 202 of the rotating member 104. In various embodiments, the cap 108 is attached with the center axis 400 of the cap 108 substantially aligned with the longitudinal axis 600 and axis of rotation 300. In various embodiments, the axis 300,400, 600 are substantially aligned to form the center axis 200 of the wrap dispenser 100. Attaching the cap 108 prevents removal of the holding member 102 from the rotating member 104 over the first end 202 of the rotating member 108. In particular, attaching the cap 108 captures and holds the holding member 102 on the engaging portion 206 of the rotating member 104 between the roll of wrap 106 positioned on a roll-holding portion 208 of the rotating member 104 and the first end 202 of the rotating member 104. This may prevent the holding member 102 from coming off the dispenser 100 during use. In various embodiments, the cap 108 is detachably attached to the first end 202 of the rotating member 104 and abuts the holding member 102. In these embodiments, the cap 108 includes an attachment mechanism for detachably engaging the rotating member 104.

When the cap 108 is attached to the dispenser 100, at least a part of the insertion portion 218 is inserted through the first end opening 704 defined by the collar 702 of the holding member 102 and into the rotating member 104. When attached, the stop surface 410 of the cap 108 is adjacent to the first end 210 and outer surface 708 of the holding member 102. In various embodiments, when the cap 108 is attached to the dispenser 100, the end gap 902 is formed between the stop surface 410 and the first end surface 308 of the rotating member 104. The end gap is maintained by the shoulder 416. This end gap allows for free rotation of the rotating member 104 relative to the holding member 102 while a user holds the holding member 102 without generating any significant friction with the cap 108, which will rotate with the rotating member 104, and the holding member 102.

Figure 10:
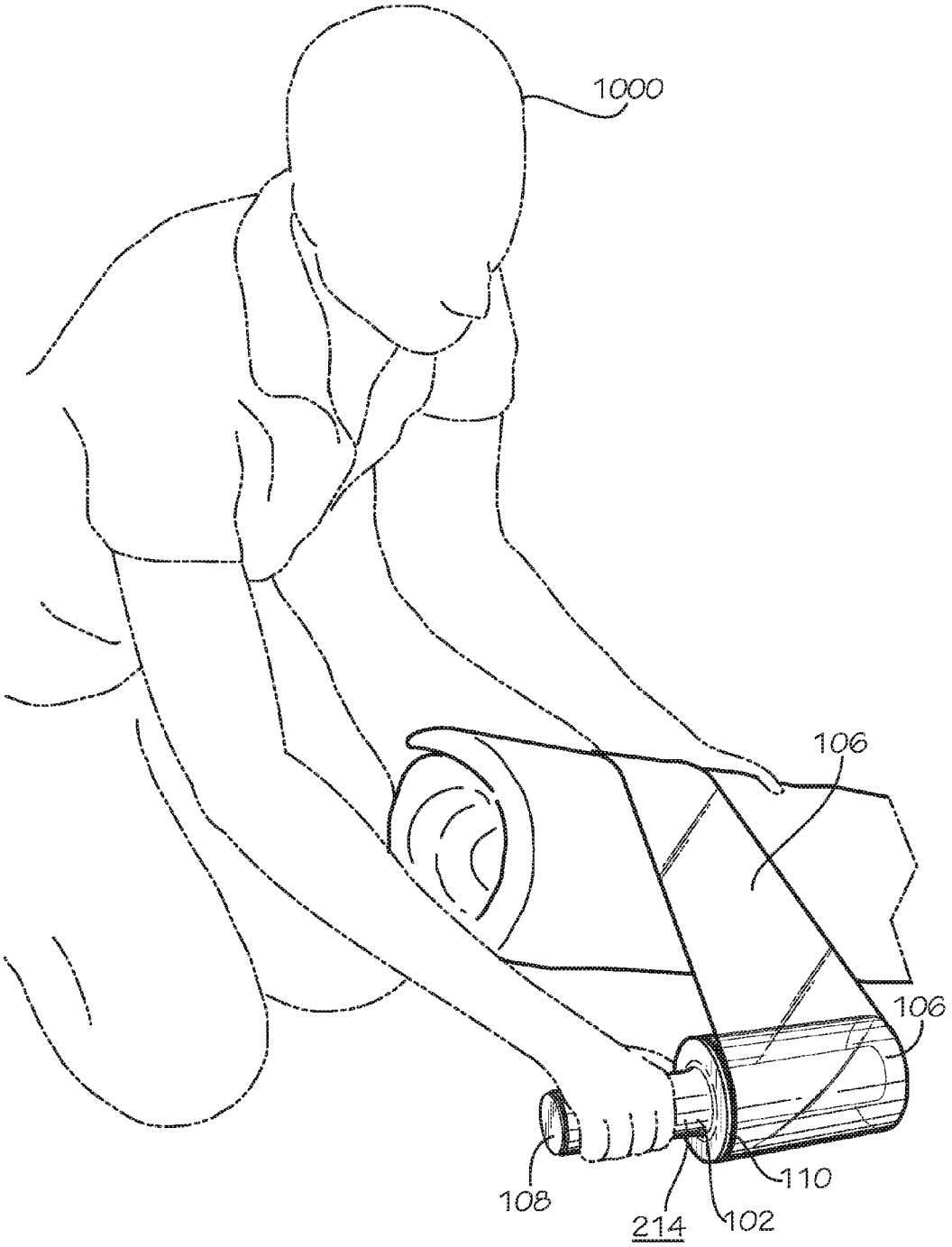
FIG. 10 is perspective view of the wrap dispenser of FIG. 1 being held and used by a user.

Focusing now on FIG. 10, a method of dispensing wrap 106 using a dispenser 100 will be described in further detail. It should be noted that any of the steps of any of the methods described herein may be performed in any order or could be performed in sub-steps that are done in any order or that are separated in time from each other by other steps or sub-steps, and the disclosure of a particular order of steps should not be considered limiting on the current disclosure. A user 1000 first obtains a wrap dispenser 100 which includes the rotating member 104 with wrap 106 wrapped around the rotating member 104, the holding member 102 on the engaging portion 206 of the rotating member 104, and the cap 108 attached to the rotating member 104 such that the cap 108 and wrap 106 capture the holding member 102 on the engaging portion 206 of the rotating member 104.

The user 1000 holds and grips the outer holding surface 214 of the holding member 102 and begins dispensing the wrap 106 with the flange 110 separating the user from the wrap 106. Although the user 1000 is holding the holding member 102, the rotating member 104 freely rotates around its axis of rotation 300 to dispense the wrap 106 because the inner surface 216 of the holding member 102 is not compressed against the outer surface 302 of the engaging portion 206 of the rotating member 104. The inner surface 216 and outer surface 302 are sufficiently smooth in the current embodiment such that the friction between the inner surface 216 and outer surface 302 is not sufficient to significantly resist rotation of the rotating member 104.

As the wrap 106 is being dispensed, the user 1000 may increase tension in the film by clenching his or her hand and applying pressure to the holding member 102. In particular, frictional engagement occurs when the inner surface 216 of the holding member 102 directly engage the outer surface 302 of the rotating member 104 after the inner surface 216 collapses during compression. In various embodiments, the holding member 102 directly engages the rotating member 104 when compressed to stop rotation of the rotating member 104. This frictional engagement increases friction between the rotating member 104 and the holding member 102 due to the increased surface contact and pressure between the inner surface 216 and the outer surface 302 and causes the rotating member 104 to slow down or stop rotating altogether. This allows the user 1000 to tension or stretch the wrap when the user 1000 holds the dispenser 100 in place or continues to move the dispenser 100 with the roll of wrap 106, as previously described. Thus the dispenser 100 holds the wrap taut around the object or objects being wrapped, preventing the unrolled wrap from becoming loose around the object or objects or during the dispensing.

In various other embodiments, the user 1000 may also slide the holding member 102 along the rotating member 104 while clenching the holding member 102 such that the outer surface 708 of the holding member 102 frictionally engages the stop surface 410 of the cap 108. In various embodiments, the inner surface 706 of the collar 702 of the holding member 102 may also contact and frictionally engage the first end surface 308 of the rotating member 104. In these embodiments, the frictional engagement between any the compressed holding member 102 and the rotating member 104, between the collar 702 and the rotating member 104, and between the holding member 102 and the cap 108, either individually or in any desired combination, causes the rotating member 104 to slow down or stop rotating altogether. This results in tensioning or even stretching of the wrap to occur when the user holds the dispenser 100 in place or continues to move the dispenser 100 with the roll of wrap 106, as previously described.

Figure 12:
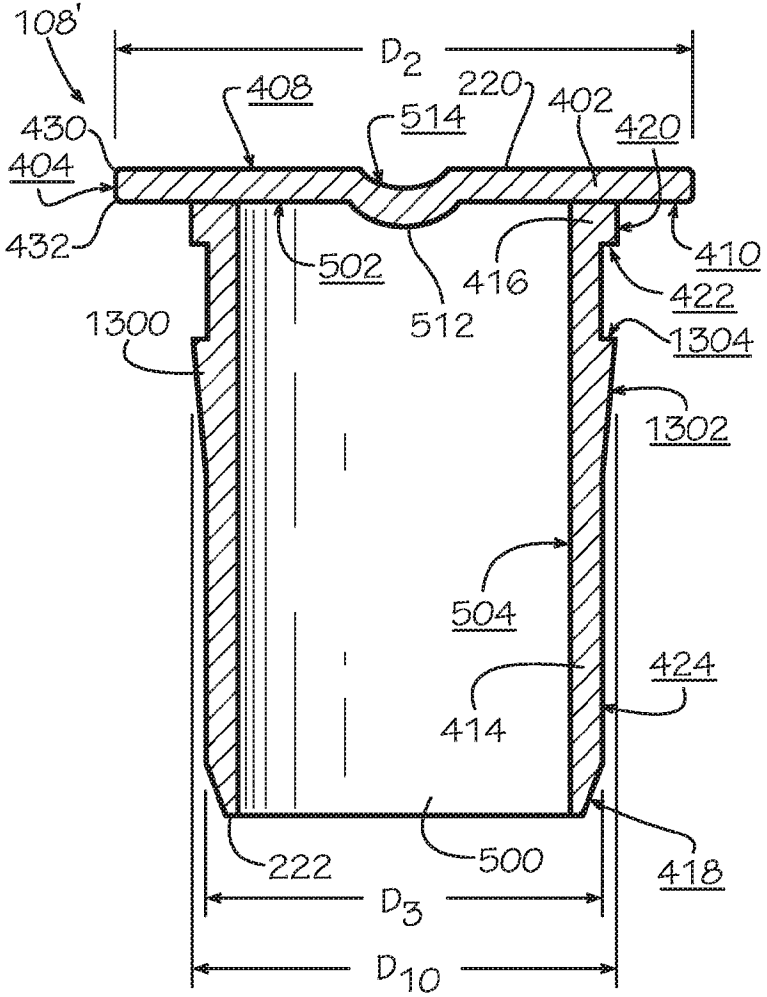
FIG. 12 is a cross-sectional view of the cap of FIG. 11.
Figure 11:
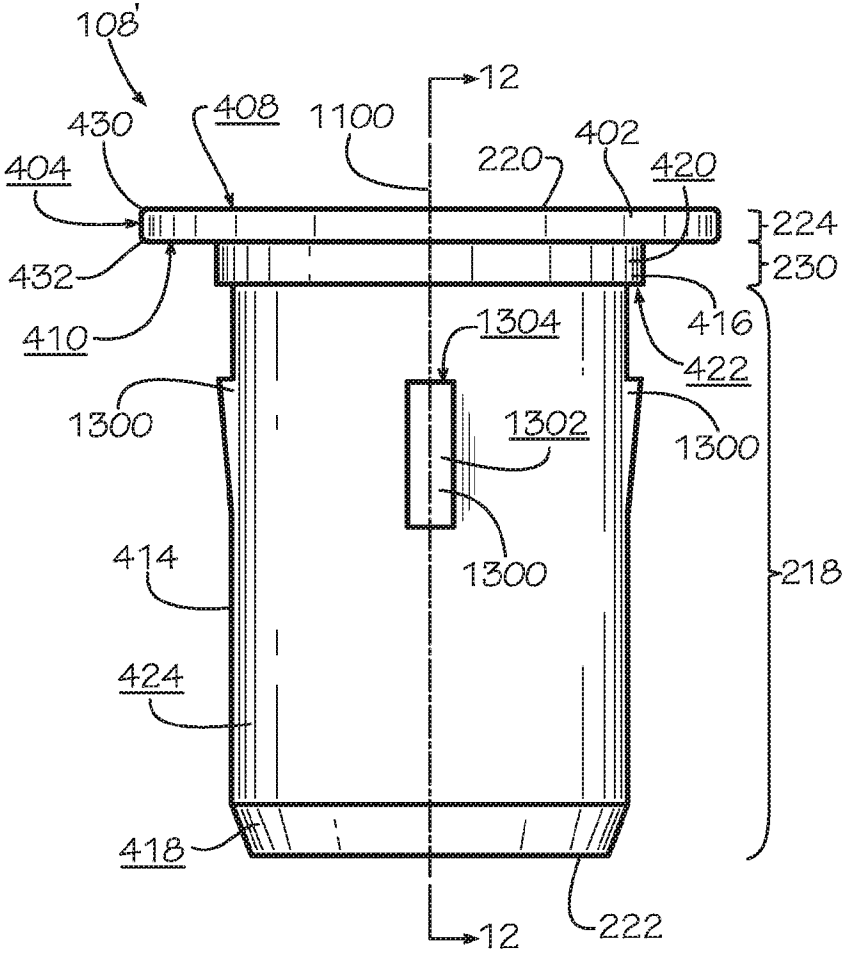
FIG. 11 is a side view of the cap according to another embodiment of the present disclosure.

As shown in FIG. 11 and FIG. 12, in another embodiment of the cap 108', the insertion portion 218 of the cap 108' can be extended in length along axis 1100. In other embodiments, the cap 108' can be substantially longer or shorter than the embodiment shown. The cap 108' can also comprise a plurality of vertical ribs 1300 defined by the outer surface 424 of the inner circumferential wall 414. The plurality of vertical ribs 1300 can be radially spaced around an outer circumference of the inner circumferential wall 414. In the current embodiment, four vertical ribs 1300 are radially spaced around the outer circumference of the inner circumferential wall 414 at 90 degrees from each other, though greater or fewer vertical ribs 1300 can be spaced around the outer circumference of the inner circumferential wall 414 at different angles, and the vertical ribs 1300 can be spaced equally or at varying angles in other embodiments. Each vertical rib 1300 defines a tapered surface 1302, a shoulder surface 1304, and two side surfaces. Each vertical rib 1300 extends radially outwardly from the outer surface 424 of the inner circumferential wall 414. Because the tapered surface 1302 tapers in a downward direction away from the rim portion 224 and the shoulder portion 230, the tapered surface 1302 can aid in the insertion of the insertion portion 218 of the cap 108' into the first end 202 of the rotating member 104. The shoulder surface 1304 can be sized to dig into the inner surface 304 of the rotating member 104 in order to secure the cap 108' to the rotating member 104 and resist the withdrawal of the insertion portion 218 from the first end 202 of the rotating member 104.

In the embodiment shown, an outermost diameter $D_{10}$ of the vertical ribs 1300 is larger than the diameter $D_3$ of the outer surface 424 of the inner circumferential wall 414. The outermost diameter $D_{10}$ is also larger than the inner diameter $D_7$ of the inner surface 304 of the rotating member 104 in order for the vertical ribs 1300 to dig into the inner surface 304 upon insertion. In the embodiment shown, the outermost diameter $D_{10}$ of the vertical ribs is smaller than the diameter defined by the vertical surface 420 of the shoulder 416. The shape and the size of the vertical ribs 1300 should not be considered limiting, however. In some embodiments, the cap can comprise an unbroken circumferential ring defining the tapered surface 1302 and the shoulder surface 1304 in place of separate vertical ribs 1300.

Figure 13:
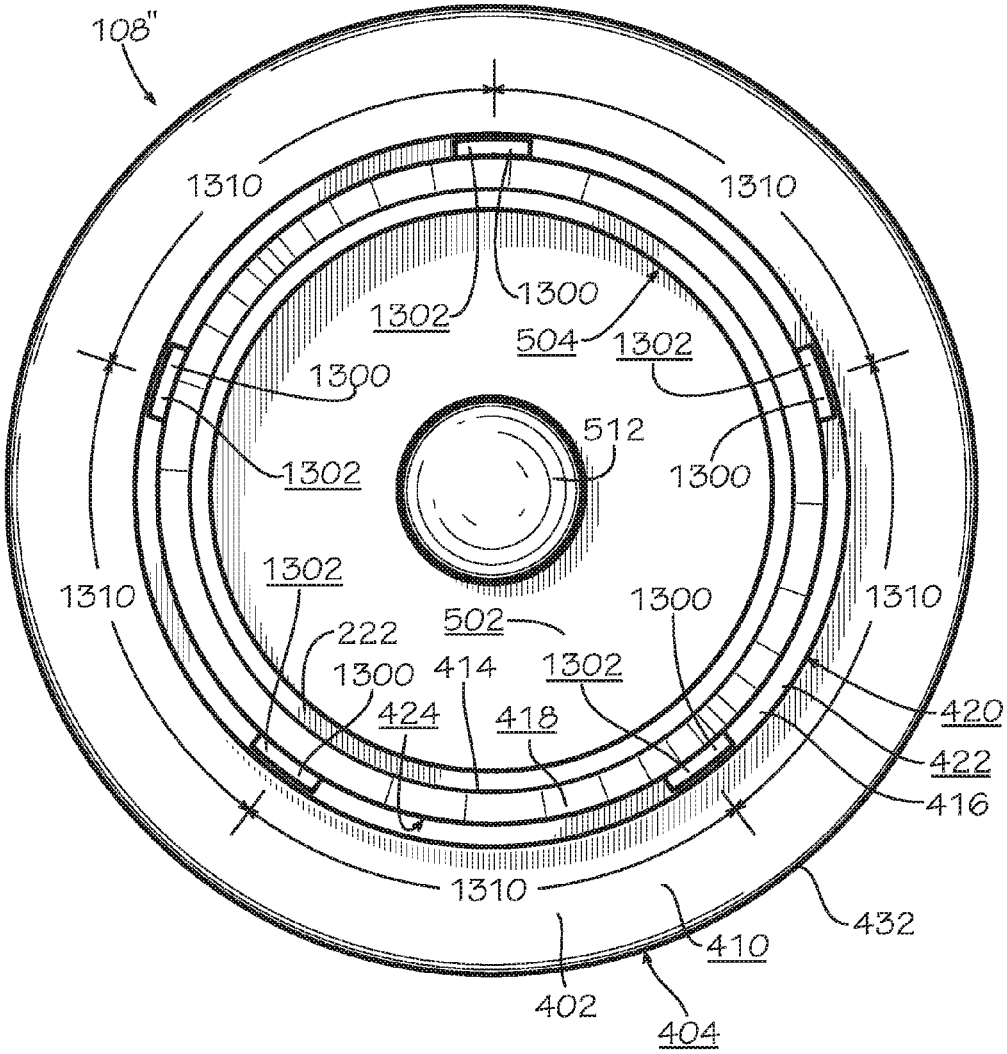
FIG. 13 is a bottom view of the cap according to another embodiment of the present disclosure.

FIG. 13 depicts a bottom view of another embodiment of the cap 108" facing the second end 222. The embodiment shown comprises five vertical ribs 1300 evenly radially distributed around the outer circumference of the inner circumferential wall 414, but is otherwise identical to the embodiment shown in FIGS. 11-12. Each pair of vertical ribs 1300 is separated by an angle 1310 which is equal to 72 degrees in the embodiment shown. The cap 108" can comprise greater or fewer vertical ribs 1300 in other embodiments, and the vertical ribs 1300 can be distributed in any axially- or radially-spread pattern. As shown in FIGS. 11, 12, and 13, the vertical ribs 1300 are positioned radially-inward from the vertical surface 420 of the shoulder 416, and the outermost diameter of vertical ribs 1300 is smaller than the diameter defined by the vertical surface 420 of the shoulder 416.

This assembly configuration represents one of many possible assembly configurations. One skilled in the art will understand that obvious variations of this assembly configuration are included within this disclosure, including variations of steps, combinations of steps, and dissections of steps, among others. Where materials are chosen for the elements of this assembly, particularly corrugated or uncorrugated paperboard, rubber, metal, and plastic, similar material choices may also be used and would be obvious to one in the art. In particular, the rotating member 104 and/or holding member 102 is constructed from the group including, but not limited to, corrugated or uncorrugated paperboard, cast iron, steel, aluminum, titanium, copper, brass, various plastics, resins, composites, or any material of sufficient strength to withstand the loads placed on them when dispensing film or other wrap materials from a roll but resilient enough to allow compression of the holding member 102 to frictionally engage the rotating member 104, or any combination of the foregoing materials. In particular, in various embodiments, the holding member 102 and the rotating member 104 are made from a corrugated paperboard. In various other embodiments, the holding member 102 may be made from polyethylene foam and the rotating member is made from plastic or corrugated paperboard. The cap 108 is constructed from the group including, but not limited to, flexible and resilient material that may be selectively compressed or deformed to allow detachable engagement with the rotating member 104 such as a plastic or rubber-like material. In various other embodiments, only a portion of the cap 108 is constructed from plastic or rubber-like material. Another portion may be constructed from various other metals, plastics, resins, composites, or other material that need not be flexible and resilient. Furthermore, the configuration of either member need not be annular but could be another configuration depending on the application.

Finally, additional members may be added to the wrap dispenser 100 and various components may be split into other components. For one example among others, an elastomeric component may be applied to the outer holding surface 214 of the holding member 102 to aid in grip. In such a case, the elastomeric component would be considered a portion of the holding member 102. This elastomeric component could be added to a plastic holding member 102 using molding technology or methods known in the art.

One should note that conditional language, such as, among others, "can," "could," "might," or "may," unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more particular embodiments or that one or more particular embodiments necessarily include logic for deciding, with or without user input or prompting, whether these features, elements and/or steps are included or are to be performed in any particular embodiment.

It should be emphasized that the above-described aspects are merely possible examples of implementations, merely set forth for a clear understanding of the principles of the present disclosure. Many variations and modifications can be made to the above-described embodiment(s) without departing substantially from the spirit and principles of the present disclosure. All such modifications and variations are intended to be included herein within the scope of the present disclosure, and all possible claims to individual aspects or combinations of elements or steps are intended to be supported by the present disclosure. Moreover, although specific terms are employed herein, as well as in the claims which follow, they are used only in a generic and descriptive sense, and not for the purposes of limiting the present disclosure, nor the claims which follow.

That which is claimed is:

1. A dispenser comprising:

a rotating member including a first end and a second end, the rotating member having an inner surface and defining an axis of rotation that extends from the first end to the second end;

a holding member having an inner surface, an outer holding surface, and a collar at a first end of the holding member, the inner surface enclosing an engaging portion of the rotating member, the holding member configured to rotate relative to the rotating member; and a cap attached to the first end of the rotating member and retaining the holding member on the rotating member, the collar of the holding member positioned at least partially directly between an end surface at the first end of the rotating member and a stop surface of the cap within an end gap defined between the end surface and the stop surface providing clearance for the collar.

2. The dispenser of claim 1, wherein the cap defines a rim portion, a shoulder portion, and an insertion portion, the shoulder portion positioned between the rim portion and the insertion portion.

3. The dispenser of claim 2, wherein the insertion portion of the cap is positioned within the rotating member and frictionally engages the inner surface of the rotating member, the cap rotationally fixed to the rotating member.

4. The dispenser of claim 3, wherein the shoulder portion is configured to limit how far the insertion portion is inserted into the rotating member.

5. The dispenser of claim 2, wherein the stop surface is defined by the rim portion of the cap, the shoulder portion sized to maintain the end gap between the stop surface and the end surface of the rotating member.

6. The dispenser of claim 2, wherein the rim portion has an outer rim diameter, the shoulder portion has an outer shoulder diameter, and the insertion portion has an outer insertion portion diameter, the outer shoulder diameter sized to be larger than the outer insertion portion diameter but smaller than the outer rim diameter.

7. The dispenser of claim 1, wherein the rotating member comprises a roll of wrap disposed on the rotating member between the second end of the rotating member and the engaging portion of the rotating member, and interference between the collar and the first end of the rotating member prevents contact between the holding member and the roll of wrap.

8. The dispenser of claim 1, wherein the inner surface of the holding member defines a protuberance extending radially inwardly from the inner surface towards the engaging portion of the rotating member.

9. The dispenser of claim 8, wherein the protuberance is a circumferential rib.

10. The dispenser of claim 8, wherein the protuberance is defined proximate the collar.

11. The dispenser of claim 1, wherein the cap comprises an inner circumferential wall positioned within the first end of the rotating member, the inner circumferential wall having an outer surface defining a vertical rib extending radially outwardly from the outer surface.

12. A method of assembling a wrap dispenser comprising:

sliding a holding member onto the engaging portion of a rotating member; and inserting an insertion portion of a cap through a collar of the holding member and into a first end of the rotating member, the insertion portion frictionally engaging an inner surface of the rotating member, at least a portion of the collar retained between an end surface at the first end of the rotating member and a stop surface of a rim of the cap.

13. The method of claim 12, wherein the insertion portion comprises an inner circumferential wall defining an outer surface, the outer surface defining a vertical rib extending outwardly from the outer surface, the vertical rib resisting withdrawal of the insertion portion from the first end of the rotating member after inserting the insertion portion into the first end of the rotating member.

14. The method of claim 12, wherein the insertion portion of the cap is inserted into the rotating member until a shoulder portion of the cap rests against the end surface of the first end of the rotating member.

15. The method of claim 12, wherein the holding member has a protuberance defined by an inner surface of the holding member, the protuberance configured to align the holding member on the engaging portion of the rotating member.

16. The method of claim 15, wherein the protuberance is a circumferential rib extending radially inwardly from the inner surface of the holding member.

17. The method of claim 12, wherein:

the holding member includes the collar at a first end of the holding member;

the holding member includes a flange at a second end of the holding member; and enclosing an engaging portion of the rotating member includes positioning a flange surface of the flange adjacent to a roll of wrap positioned on a roll-holding portion of the rotating member, interference between the collar and the first end of the rotating member preventing contact between the roll of wrap and the second end of the holding member.

18. A method of dispensing wrap from a roll using a dispenser, the method comprising:

gripping onto an outer holding surface of a holding member of the dispenser, the holding member enclosing an engaging portion of a rotating member of the dispenser, the dispenser further including:

wrap wrapped around a roll-holding portion of the rotating member, and a cap attached to the first end of the rotating member and holding the holding member with a collar of the holding member positioned at least partially directly between an end surface at the first end of the rotating member and a stop surface of the cap, an end gap between the end surface and the stop surface providing clearance for the collar; and dispensing the wrap by rotating the rotating member relative to the holding member.

19. The method of claim 18, wherein the cap has a shoulder portion which maintains the end gap.

20. The method of claim 18, further comprising applying pressure onto the holding member to increase the tension in the wrap being dispensed.

21. The method of claim 20, wherein applying pressure onto the holding member includes compressing the holding member to engage the rotating member, and wherein compressing the holding member includes increasing the resistance to rotation of the rotating member and tension in the wrap by increasing the friction between the rotating member and the holding member.

22. The method of claim 18, further comprising slidably positioning the holding member on the rotating member to engage an inner surface of the collar with the end surface of the rotating member, wherein engaging the inner surface of the collar with the end surface of the rotating member increases the resistance to rotation of the rotating member and tension in the wrap by increasing the friction between the rotating member and the holding member.

* * * * *